US006132190A

United States Patent [19]

Tverskoy

[11] Patent Number: 6,132,190

[45] Date of Patent: Oct. 17, 2000

[54] ROTARY DEVICE

[76] Inventor: Boris S. Tverskoy, 351 Edlee Ave., Palo Alto, Calif. 94306

[21] Appl. No.: 09/137,665

[22] Filed: Aug. 20, 1998

[51] Int. Cl.[7] ..... F03C 2/00

[52] U.S. Cl. ..... 418/35

[58] Field of Search ..... 123/245, 204; 418/35; 417/28

[56] References Cited

U.S. PATENT DOCUMENTS

| | | | |
|---|---|---|---|
| 2,072,482 | 3/1937 | Myard | 418/35 |
| 3,227,090 | 1/1966 | Bartolozzi | 418/35 |
| 3,333,546 | 8/1967 | Bulutay | 418/35 |
| 3,712,081 | 1/1973 | Philipp et al. | 418/35 |
| 3,935,841 | 2/1976 | Longeval . | |
| 4,890,591 | 1/1990 | Stauffer | 418/35 |
| 5,568,796 | 10/1996 | Palmer | 123/204 |
| 5,697,763 | 12/1997 | Kitchener | 417/28 |

FOREIGN PATENT DOCUMENTS

| | | |
|---|---|---|
| 2249350 | 6/1992 | United Kingdom . |

*Primary Examiner*—Thomas Denion
*Assistant Examiner*—Tu M. Nguyen
*Attorney, Agent, or Firm*—Skjerven Morrill MacPherson LLP; Alan H. MacPherson; Daniel P. Stewart

[57] ABSTRACT

A rotary device for use in pumping applications or as an internal combustion engine is disclosed. The rotary device includes a cylinder and first and second axles that rotate within the cylinder. Each axle has a fin set with at least one fin subdividing the cylinder. A drive shaft has a first terminus coupled to the first axle by at least one universal joint and a second terminus coupled to the second axle by at least one universal joint. In one embodiment, the rotary device includes a fluid inlet port and a fluid outlet port formed in a wall of the cylinder. The fluid inlet port allows fluid to enter the cylinder, while the fluid outlet port allows fluid to exit the cylinder. In one embodiment, the rotary device includes a motor operable to rotate the drive shaft, thereby allowing fluid to be pumped into and out of the cylinder. In another embodiment, the rotary device includes an ignition source attached to the cylinder, the ignition source being operable to ignite a fuel within the cylinder.

21 Claims, 5 Drawing Sheets

ROTARY DEVICE

TECHNICAL FIELD OF THE INVENTION

The present invention relates to mechanical power transfer devices, and in particular to a rotary device useful for pumping and internal combustion engine applications.

BACKGROUND OF THE INVENTION

Internal combustion engines are in common use throughout the world and are well known. Such engines typically involve one or more pistons in which a fuel mixture, such as gasoline and air, is drawn into a cylinder, compressed and ignited to drive a piston head. The power from the fuel ignition is transferred to a rotating drive shaft. As the drive shaft turns, the piston head drives the exhaust gas out of the cylinder, and the cycle is repeated.

The transfer of power from an oscillatory (one-dimensional) motion of the piston head to a rotational (two dimensional) motion of the drive shaft in a typical engine causes a certain amount of power loss. This power loss is inherent in the design of the conventional piston-based engine. In addition, the introduction of a spark into the piston must be precisely timed to maximize the power generated by the engine. The timing mechanisms of conventional gasoline engines are subject to undesirable changes over time, giving rise to loss of power and "knocking" or "spark ping" which is not easily corrected by the user.

Pumps and compressors for pumping liquids and gases are also well known. Various pump designs are known, and the pump design typically is tailored to the particular application for which the pump is intended. A single, multipurpose pump design which may practically be used for pumping a variety of fluids has not heretofore been available.

SUMMARY OF THE INVENTION

Therefore, a need has arisen for a rotary device that addresses the disadvantages and deficiencies of the prior art. In particular, a need has arisen for a rotary device for use as an high-efficiency internal combustion engine that eliminates the need for a fuel ignition timing system. In addition, a need has arisen for a rotary device for use as a multipurpose pump and/or compressor.

Accordingly, a rotary device is disclosed. The rotary device includes a cylinder and first and second axles that rotate within the cylinder. Each axle has a fin set with at least one fin subdividing the cylinder. A drive shaft has a first terminus coupled to the first axle by at least one universal joint and a second terminus coupled to the second axle by at least one universal joint.

In one embodiment, the rotary device includes a fluid inlet port and a fluid outlet port formed in a wall of the cylinder. The fluid inlet port allows fluid to enter the cylinder, while the fluid outlet port allows fluid to exit the cylinder. In one embodiment, the rotary device includes a motor operable to rotate the drive shaft, thereby allowing fluid to be pumped into and out of the cylinder. In another embodiment, the rotary device includes an ignition source attached to the cylinder, the ignition source being operable to ignite a fuel within the cylinder.

A technical advantage of the present invention is that the rotary device may be used as either an internal combustion engine, a pump or a compressor. Another technical advantage of the present invention is that an internal combustion engine constructed in accordance with the present invention exhibits high efficiency in the transfer of power to a drive shaft. Yet another technical advantage is that a pump constructed in accordance with the present invention may be used as a multipurpose pump for pumping a variety of fluids.

BRIEF DESCRIPTION OF THE DRAWINGS

For a more complete understanding of the present invention and for further features and advantages, reference is now made to the following description taken in conjunction with the accompanying drawings, in which.

DETAILED DESCRIPTION OF THE INVENTION

The preferred embodiments of the present invention and their advantages are best understood by referring to FIGS. 1 through 6 of the drawings. Like numerals are used for like and corresponding parts of the various drawings.

Figure 1:
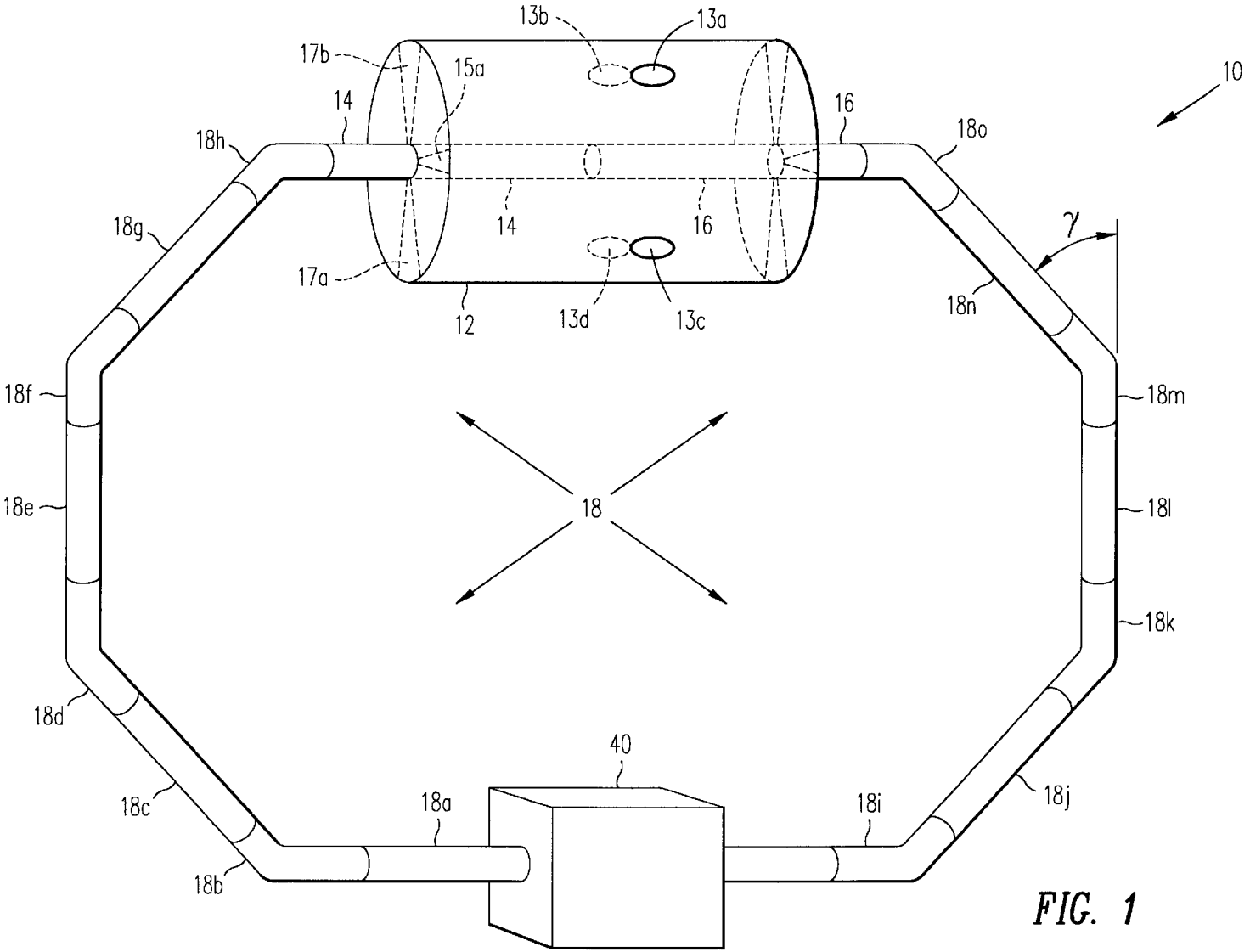
FIG. 1 is a perspective view of a rotary device constructed in accordance with the present invention.

Referring to FIG. 1, a front view of a rotary device 10 constructed in accordance with the present invention is shown. Rotary device 10 includes a cylinder 12, which is sealed against leakage of the fluid to be contained within cylinder 12. A first axle 14 extends through a port in one end-wall of cylinder 12. Axle 14 extends along the axis of cylinder 12 to the mid-point of cylinder 12. A second axle 16 extends through a port in the other end-wall of cylinder 12. Axle 16 extends along the axis of cylinder 12 to the mid-point of cylinder 12, where the terminus of axle 16 abuts the terminus of axle 14.

Cylinder 12 has four ports 13*a* through 13*d*, which allow fluids, either gaseous or liquid, to flow into and out of cylinder 12, as will be described more fully below. Ports 13*a* through 13*d* may be threaded to allow easy attachment of inlet and outlet passages and/or ignition sources, as will be described more fully below.

Figure 2:
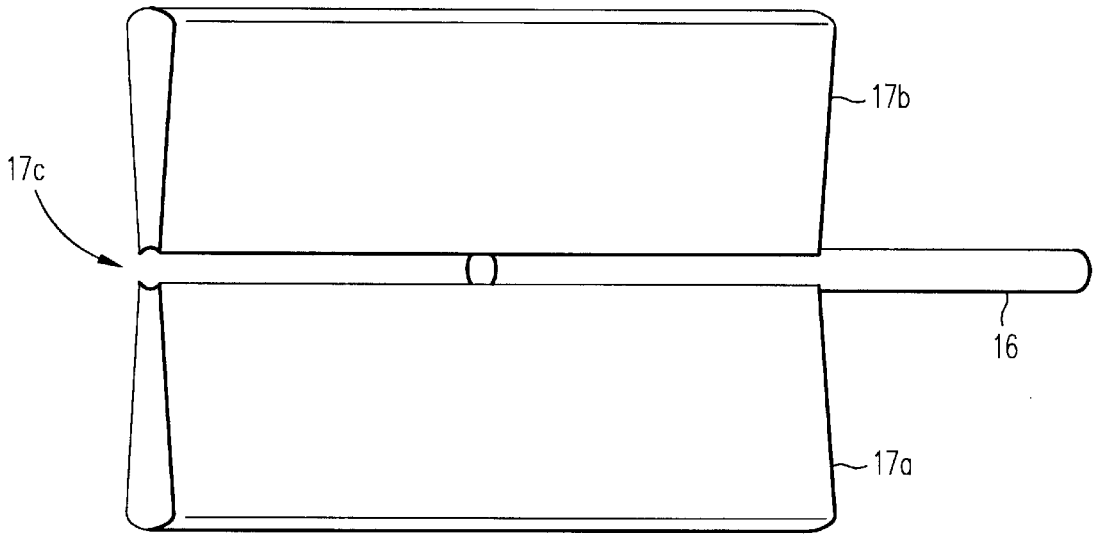
FIG. 2 is a perspective view of an axle for use in the rotary device.

Referring to FIG. 2, axle 16 is shown separately from rotary device 10. Attached to axle 16 are a bottom fin 17*a* and a diametrically opposed top fin 17*b*. Although axle 16 extends only to the midpoint of cylinder 12, fins 17*a* and 17*b* span the entire length of cylinder 12. Thus, half of the cylindrically-shaped aperture 17*c* between fins 17*a* and 17*b* is filled by axle 16. The other half of aperture 17*c* is filled by axle 14, which abuts axle 16 at the midpoint of cylinder 12. Fins 17*a* and 17*b* extend radially outward from axles 14 and 16 to the cylindrical wall of cylinder 12. Each fin 17*a* and 17*b* subtends a small radial arc within cylinder 12, as will be discussed more fully below. Fins 17*a* and 17*b* serve to partition cylinder 12 into two separate chambers, each chamber occupying somewhat less than half of cylinder 12.

Axle 14, like axle 16, has two diametrically opposed fins 15*a* and 15*b* (shown in FIG. 3) extending radially to the outer wall of cylinder 12. Axle 14 forms a mirror image of axle 16 as depicted in FIG. 2. Returning to FIG. 1, the fins 15*a* and 15*b* (not shown in FIG. 1) of axle 14 are rotated out of alignment with fins 17*a* and 17*b* of axle 16. This configuration allows axle 14 and fins 15*a* and 15*b* to interlock with axle 16 and fins 17*a* and 17*b*, so that axle 14 abuts axle 16 at the midpoint of cylinder 12.

Fins 15*a* and 15*b* of axle 14 further subdivide cylinder 12 into four separate chambers, each chamber occupying an average of somewhat less than one-quarter of cylinder 12. Because each fin 15*a*, 15*b*, 17*a*, 17*b* subtends a small arc within cylinder 12, axle 14 may be rotated with respect to axle 16 to vary the sizes of the chambers formed by fins 15*a*, 15*b*, 17*a*, 17*b*. Likewise, axle 16 may be rotated with respect to axle 14, or both axles may be rotated simultaneously. The only limitation on the rotation of axles 14 and 16 is that no two fins 15*a*, 15*b*, 17*a*, 17*b* may simultaneously occupy the same space. Thus, each chamber formed by fins 15*a*, 15*b*, 17*a*, 17*b* may vary in size from 0° to nearly 180° of cylinder 12.

Figure 3:
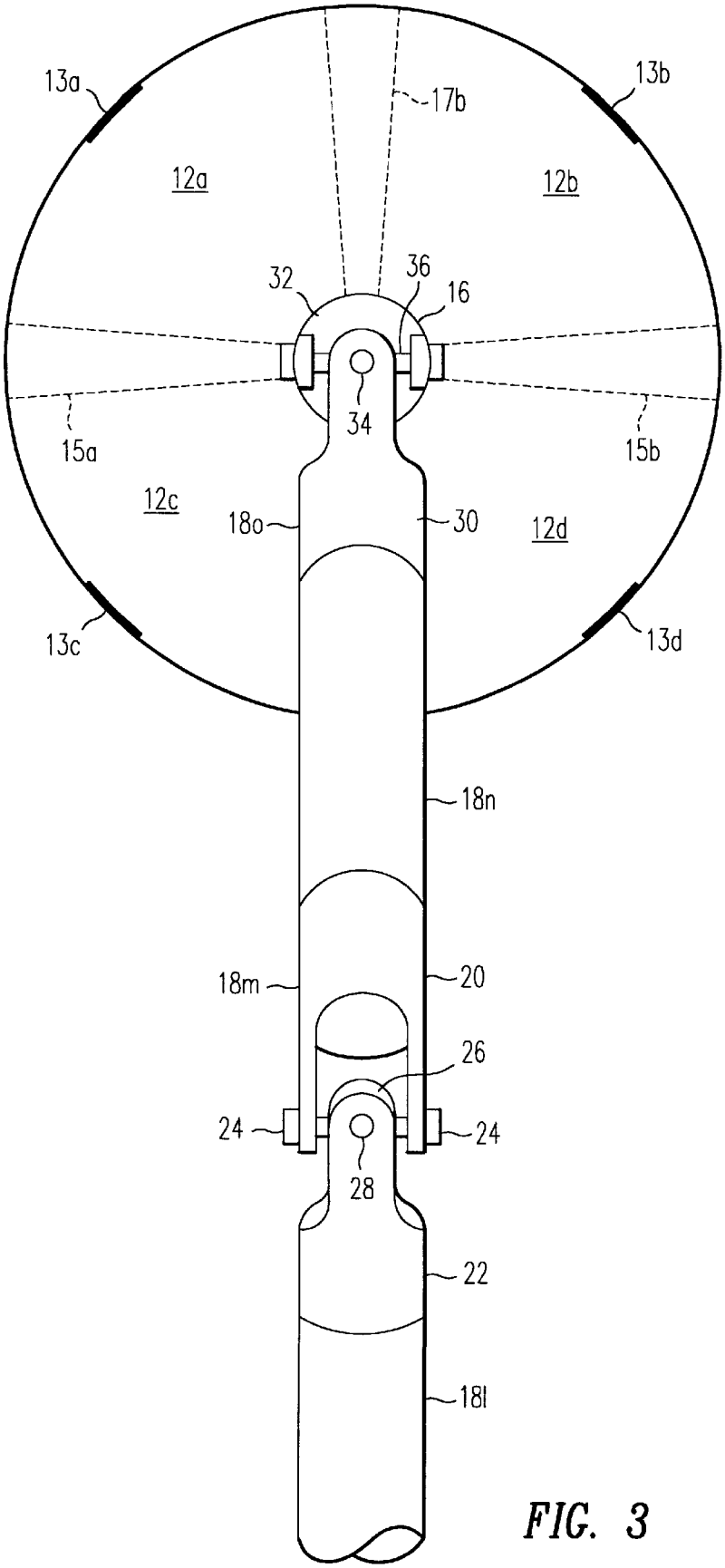
FIG. 3 is an end view of the rotary device.

Referring to FIG. 3, an end view of rotary device 10 is shown. In this view, the chambers 12*a* through 12*d* formed by fins 15*a*, 15*b*, 17*a*, 17*b* are clearly shown. The rotation of axles 14 and 16 will vary the sizes and locations of chambers 12*a* through 12*d*, so that chambers 12*a* and 12*d* are always equal in size and are always diametrically opposed. Likewise, chambers 12*b* and 12*c* are always have equal in size and will always be diametrically opposed. Any axle rotation that increases the size of chambers 12*a* and 12*d* will correspondingly decrease the size of chambers 12*b* and 12*c*, and vice versa.

Returning to FIG. 1, axles 14 and 16 are rotated by a drive assembly 18. Specifically, a primary drive shaft 18*a* is connected via a universal joint 18*b* to a secondary drive shaft 18*c*. Secondary drive shaft 18*c* is oriented at a 45° angle with respect to primary drive shaft 18*a*. Secondary drive shaft 18*c* is likewise connected via a universal joint 18*d* to a tertiary drive shaft 18*e*, which is oriented at a 45° angle with respect to secondary drive shaft 18*c*, and at a 90° angle with respect to primary drive shaft 18*a*. Tertiary drive shaft 18*e* is in turn connected via a universal joint 18*f* to a quaternary drive shaft 18*g*, which is oriented at a 45° angle with respect to both tertiary drive shaft 18*e* and axle 14. Quaternary drive shaft 18*g* is connected to axle 14 via a universal joint 18*h*.

On the opposite side of drive assembly 18, primary drive shaft 18*a* is likewise connected to a secondary drive shaft 18*j*, tertiary drive shaft 18*l*, quaternary drive shaft 18*n* and axle 16 via universal joints 18*i*, 18*k*, 18*m* and 18*o*. Each drive shaft is oriented at 45° relative to the previous drive shaft in drive assembly 18. The various drive shafts in drive assembly 18 are held in place with brackets (not shown), or some other holding device that allows rotational motion of the drive shafts.

The universal joints in drive assembly 18 are shown only symbolically in FIG. 1. Referring to FIG. 3, universal joints 18*m* and 18*o* are illustrated in more detail. Universal joint 18*m* comprises an upper segment 20 attached to quaternary drive shaft 18*n* and a lower segment 22 attached to tertiary drive shaft 18*l*. Upper segment 20 is rotatably connected to a ball 26 by a pair of aligned pins 24, which form an axis of rotation of upper segment 20 with respect to ball 26. Likewise, lower segment 22 is rotatably connected to ball 26 by a pair of aligned pins 28, which form an axis of rotation of lower segment 22 with respect to ball 26. The axis formed by pins 24 is oriented at 90° with respect to the axis formed by pins 28. This universal joint structure is well known to those skilled in the art of drive train mechanics.

The construction of universal joint 18*m* is such that a 180° rotation of drive shaft 18*l* will result in a corresponding 180° rotation of drive shaft 18*n*, and vice versa. However, if drive shaft 18*l* is driven with a constant rotation speed, drive shaft 18*n* will not rotate with an equal, constant rotation speed. Instead, the action of universal joint 18*m* will cause drive shaft 18*n* to rotate alternately faster and slower than drive shaft 18*l*.

The exact behavior of universal joint 18*m* is captured in Equation (1):

$$\tan(\beta)=\cos(\gamma)*\tan(\alpha) \tag{1}$$

In this equation, $\alpha$ is the rotation angle of drive shaft 18*l*, $\beta$ is the rotation angle of drive shaft 18*n*, and $\gamma$ is the angle between the drive shafts, in this case 45°.

Universal joint 18*o*, like universal joint 18*m*, has a lower segment 30 attached to drive shaft 18*n* and an upper segment 32 attached to axle 16. Lower segment 30 is rotatably attached to a ball (not shown) by a pair of pins 34. Similarly, upper segment 32 is rotatably attached to the ball by a pair of pins 36. Universal joint 18*o* behaves in accordance with Equation (1) above.

It will be observed that the rotation axis formed by pins 34 of universal joint 18*o* is perpendicular to the rotation axis formed by pins 24 of universal joint 18*m*. This angle ($\Delta$) defines the behavior of axle 16 relative to drive shaft 18*l*. Thus, if pins 34 were oriented parallel to pins 24 ($\Delta$=0°), axle 16 would at all times rotate at the same speed as drive shaft 18*l*. This behavior is captured in Equation 2:

$$\tan(\mu)=\cos(\gamma)*\tan(\beta)=\cos(\gamma)*\tan(\alpha)/\cos(\gamma)=\tan(\alpha) \tag{2}$$

In this equation, $\mu$ is the rotation angle of axle 16, $\gamma$ is the angle between axle 16 and drive shaft 18*n*, as well as the angle between drive shaft 18*n* and drive shaft 18*l* (in both cases 45°), and $\alpha$ and $\beta$ are as set forth in Equation 1. An examination of Equations (1) and (2) reveals that the difference in rotational speed generated by universal joint 18*m* is entirely canceled out by a corresponding rotational speed difference introduced by universal joint 18*o*. Thus, drive shaft 18*l* and axle 16 rotate at the same speed at all times.

The foregoing analysis, including Equation (2), applies only when pins 34 in universal joint 18*o* are oriented parallel to pins 24 in universal joint 18*m*. When pins 34 are oriented perpendicular to pins 24 ($\Delta$=90°), as shown in FIG. 3, the rotational speed difference introduced by universal joint 18*o* enhances, rather than cancels, the rotational speed difference introduced by universal joint 18*m*. This behavior is captured in Equation (3):

$$\tan(\mu)=\cos(\gamma)*\tan(\beta)=\cos(\gamma)*\cos(\gamma)*\tan(\alpha)=\cos^2(\gamma)*\tan(\alpha) \tag{3}$$

From Equation (3), it may be observed that, since $0 \leqq \cos^2(\gamma) \leqq 1$ for any $\gamma$, Equation (3) may be rewritten as $$\tan(\mu)=\cos(\Psi)*\tan(\alpha) \tag{4}$$

where $$\Psi=\arccos(\cos^2(\gamma)) \tag{5}$$

Thus, $\Psi$ is an artificial angle which represents the effective angle between axle 16 and drive shaft 18*l*, if axle 16 and drive shaft 18*l* were directly coupled by a single universal joint rather than two universal joints. In other words, the relative rotation of drive shaft 18*l* and axle 16 when coupled by two universal joints as shown in FIG. 3 is identical to the relative rotation that would be produced if drive shaft 18*l* and axle 16 were directly coupled by a single universal joint with an angle $\Psi$ between drive shaft 18*l* and axle 16.

From Equation (5), it may be inferred that $$\text{If } 0°<\beta<90°, \text{ then } \gamma<\Psi<90° \quad (6)$$

Thus, the effective angle Ψ between drive shaft 18*l* and axle 16 is greater than the actual angle Ψ between adjacent shafts. This greater effective angle serves to increase the disparity in angular velocities between drive shaft 18*l* and axle 16.

Equation (3) may be extended to apply to a chain of N universal joints. Thus, $$\tan(\mu)=\cos^N(\gamma)*\tan(\alpha) \quad (7)$$

In this equation, $\mu$ is the rotation angle of the last shaft in the chain, γ is the angle between adjoining shafts (e.g. 45°), and α is the rotation angle of the first shaft in the chain. Equation (6) is only applicable when, as shown in FIG. 3, the two universal joints attached to each shaft in the chain have a relative orientation angle Δ=90°.

Like Equation (3), Equation (7) may be rewritten as $$\tan(\mu)=\cos(\Psi)*\tan(\alpha) \quad (8)$$

where $$\Psi=\arccos(\cos^N(\gamma)) \quad (9)$$

From Equation (9), it may be inferred that $$\text{If } 0°<\gamma<90°, \text{ then } \gamma<\Psi<90° \quad (10)$$

Thus, the effective angle Ψ between the first and last shafts in the chain increases as the number of universal joints in the chain increases.

Returning to FIG. 1, primary drive shaft 18*a* may be rotated at a constant angular velocity by an optional motor 40. Motor 40 may be coupled to primary drive shaft 18*a* by means of a belt-and-pulley assembly, a gear assembly, or some other well known torque transfer mechanism. Motor 40 may be implemented with some applications of rotary device 10, such as a pump or compressor, but may not be necessary for other applications, such as an internal combustion engine, as will be described more fully below. Alternatively, motor 40 may be used as a starter motor for the internal combustion engine application described below.

Primary drive shaft 18*a* is coupled to axle 14 via four universal joints 18*b*, 18*d*, 18*f*, 18*h*. Thus, using Equation (7), $$\tan(\mu)=\cos^4(45°)*\tan(\alpha) \quad (11)$$

where $\mu$ is the rotation angle of axle 14 and α is the rotation angle of primary drive shaft 18*a*.

Similarly, primary drive shaft 18*a* is coupled to axle 16 via four universal joints 18*i*, 18*k*, 18*m*, 18*o*. However, universal joint 18*i* is attached to primary drive shaft 18*a* with an orientation which is perpendicular to the orientation of universal joint 18*b*. Thus, Equation 11 does not accurately describe the motion of axle 16. Instead, the motion of axle 16 is described by the following equation:

$$\tan(\nu)=\cos^4(45°)*\tan(\alpha+90°) \quad (12)$$

where ν is the rotation angle of axle 14.

Since universal joints 18*b* and 18*i* have a relative orientation angle Δ=90°, axle 14 is effectively coupled to axle 16 via eight universal joints. Using Equation (7), the following relationship may be obtained:

$$\tan(\mu)=\cos^8(45°)*\tan(\nu) \quad (13)$$

In this equation, ν is the rotation angle of axle 14 and $\mu$ is the rotation angle of axle 16. Equation (13) may be rewritten as $$\tan(\mu)=\cos(\Delta)*\tan(\nu) \quad (14)$$

where $$\Psi=\arccos(\cos^8(45°))\approx 86° \quad (15)$$

Thus, the relative motion of axles 14 and 16 is the same as that of two shafts connected by a single universal joint at an angle of approximately 86°. However, drive assembly 18 offers considerable improvements over a system with only two shafts and one universal joint. For example, when a universal joint is bent at such a high angle as 86°, the mechanical stresses on the universal joint components are greatly increased, thus decreasing the lifetime and reliability of the universal joint.

In addition, drive assembly 18 has a primary drive shaft 18*a* driven at a constant angular velocity. Thus, the rotation angle α of primary drive shaft 18*a* may be expressed as follows:

$$\alpha=\omega t \quad (16)$$

where ω is the angular velocity of primary drive shaft 18*a* and t is time. Substituting Equation (16) in Equations (11) and (12), the following relationships may be obtained:

$$\tan(\mu)=\cos^4(45°)*\tan(\omega t) \quad (17)$$

$$\tan(\nu)=\cos^4(45°)*\tan(\omega t+90°) \quad (18)$$

These relationships are illustrated in FIGS. 4A through 4E, which represent cross sections of cylinder 12 at intervals of 45° of rotation of primary drive shaft 18*a*.

Figure 4A:
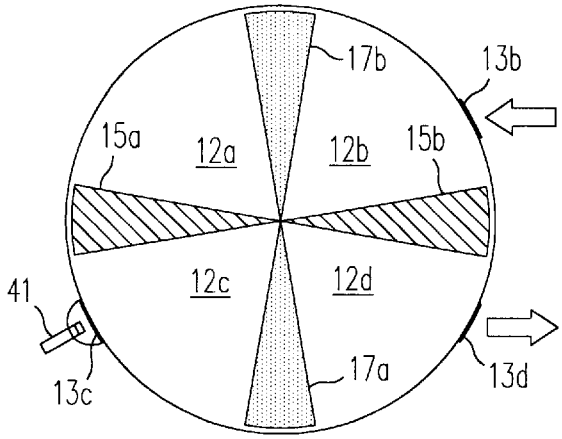
FIGS. 4A through 4E are end views of the rotary device at various stages of rotation.

Referring to FIG. 4A, primary rotation shaft 18*a* has a rotation angle α=0°. At this starting point, fins 15*a* and 15*b* are horizontal and fins 17*a* and 17*b* are vertical, as shown in FIG. 3.

Figure 4B:
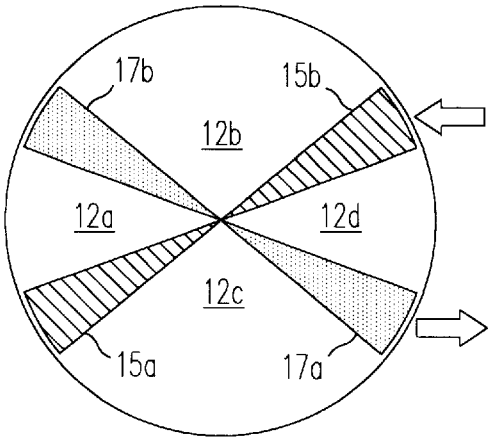

Referring to FIG. 4B, primary rotation shaft 18*a* is rotated 45°. In this interval, fins 15*a* and 15*b* have rotated approximately 25° counterclockwise while fins 17*a* and 17*b* have rotated approximately 65° counterclockwise from their starting positions. Thus, chambers 12*a* and 12*d* have been compressed, while chambers 12*b* and 12*c* have expanded.

Figure 4C:
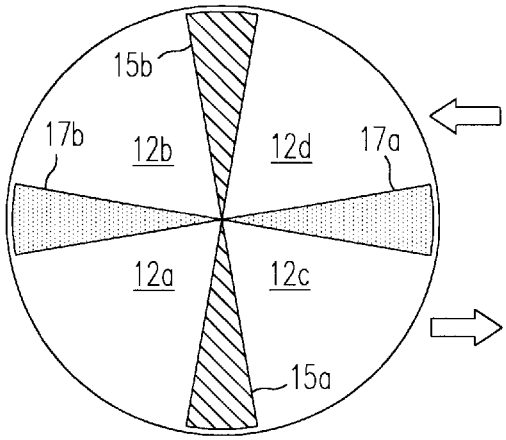
Figure 4D:
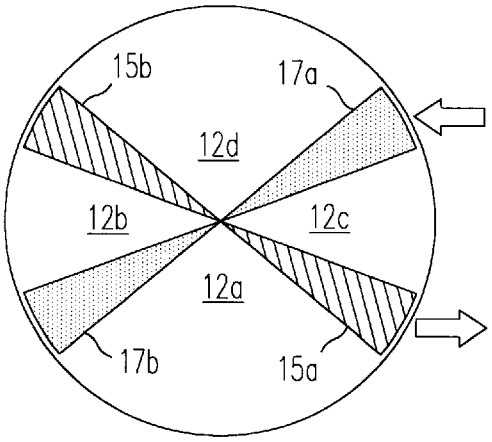
Figure 4E:
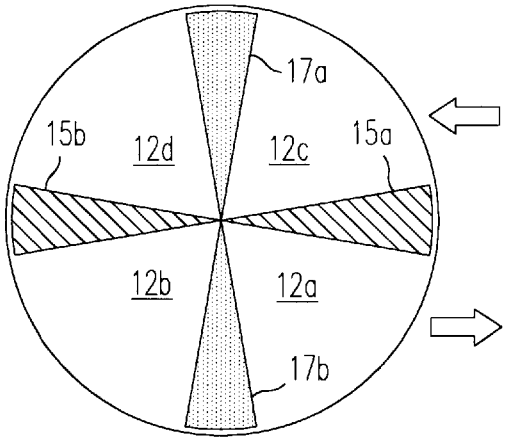

Referring to FIG. 4C, primary drive shaft 18*a* has rotated 90° from its starting point, as have fins 15*a*, 15*b*, 17*a* and 17*b*, returning chambers 12*a* through 12*d* to their original size. Referring to FIG. 4D, primary drive shaft 18*a* has rotated 135° from its starting point. Fins 15*a* and 15*b* have rotated approximately 155°, while fins 17*a* and 17*b* have rotated approximately 125° from their starting point. Thus, chambers 12*b* and 12*c* are now compressed, while chambers 12*a* and 12*d* have expanded. Referring to FIG. 4E, primary drive shaft 18*a* has rotated 180° from its starting point, as have fins 15*a*, 15*b*, 17*a* and 17*b*, returning chambers 12*a* through 12*d* to their original size.

Thus, in the rotation of primary drive shaft 18*a* by 180°, each chamber 12*a* through 12*d* has undergone one expansion and one compression. This process of expansion and compression of the chambers is repeated twice for every full revolution of primary drive shaft 18*a*.

Because primary drive shaft 18*a* is driven at a constant angular velocity, each chamber experiences compression at the same speed and for the same duration as each other chamber. Likewise, the expansion of each chamber occurs at the same speed and for the same duration. Moreover, the compression cycle of any one chamber occurs at the same speed and for the same duration as the expansion cycle for that chamber. These characteristics are similar to those of most internal combustion engines, and are desirable for internal combustion engine, pump and compressor applications, which will be described more fully below. An examination of Equation (13) reveals that rotary device 10 would not have the aforementioned desirable characteristics if either axle 14 or axle 16 were driven at a constant angular velocity, rather than primary drive shaft 18*a*.

Another desirable characteristic of rotary device 10 is that each chamber 12*a*, 12*b*, 12*c*, 12*d* reaches its points of maximum compression and expansion at the same position within cylinder 12. Indeed, for any given point around the circumference of cylinder 12, each chamber is at the same stage of compression or expansion when it passes that point. This characteristic is important in the positioning of ports 13*a* through 13*d*, as will be described more fully below.

In the foregoing description, reference has been made to "shafts" in connection with drive assembly 18. However, it will be understood that any rotatable object, whether cylindrical and oblong or not, may be used as a "shaft" to couple consecutive universal joints together. Alternatively, the universal joints may be directly connected, in which case the connected elements of the universal joints form the "shafts" referred to herein.

One application for rotary device 10 is as an internal combustion engine. This application is illustrated in FIGS. 4A through 4E. In this application, port 13*b* serves as a fuel mixture inlet. Port 13*b* is preferably positioned so that each chamber 12*a*, 12*b*, 12*c*, 12*d* is exposed to port 13*b* approximately at the position of maximum compression of the chamber, so that each chamber is exposed to port 13*b* during all or most of the expansion cycle of the chamber. The fuel intake (expansion) cycle for chamber 12*d* is illustrated in FIGS. 4B, 4C and 4D. It will be understood that fuel inlet port 13*b* may comprise either a passive fuel intake system or a fuel injection system such as those commonly used in conventional piston engines.

Port 13*a*, not shown in FIG. 4, is preferably absent or sealed to prevent leakage of the fuel mixture during the compression cycle of the chamber. The compression cycle for chamber 12*b* is illustrated in FIGS. 4B, 4C and 4D.

Port 13*c* has an ignition source 41 such as a spark plug placed therein. Ignition source 41 preferably does not intrude into cylinder 12, so as not to interfere with the rotation of fins 15*a*, 15*b*, 17*a*, 17*b*. Thus, a recessed cavity with an ignition source contained therein may be attached to port 13*c*. Ignition source 41 may alternatively be a "glow plug," with a surface heated to a temperature greater than or equal to the ignition temperature of the fuel mixture.

Port 13*c* is preferably positioned so that each chamber 12*a*, 12*b*, 12*c*, 12*d* is exposed to port 13*c* approximately at the position of maximum compression of the chamber. Thus, the ignition of the fuel mixture in the chamber will create pressure to drive the expansion of the chamber, thereby providing the motive force for the engine. If ignition source 41 is a spark plug, the spark "timing" of rotary device 10 may be controlled electrically or mechanically. Thus, ignition source 41 may be made to generate a spark at a particular moment during a chamber's exposure to ignition source 41, typically near the chamber's point of maximum compression. This timing mechanism is similar to those commonly used in piston engines.

Alternatively, the ignition source 41 may generate sparks continuously during the operation of the engine, so that the fuel in a chamber is ignited as soon as the chamber is exposed to ignition source 41. In this embodiment, the placement of ignition source 40 determines the timing of the engine. Thus, ignition source 41 is preferably positioned so that each chamber is exposed to ignition source 41 approximately at the chamber's point of maximum compression. This latter timing method is used when ignition source 41 is a continuously heated "glow plug."

Port 13*d* serves as an exhaust outlet port, and may therefore be connected to an exhaust pipe, muffle, catalytic converter or other exhaust processing mechanism. Port 13*d* is preferably positioned so that each chamber is exposed to port 13*d* approximately at the position of maximum expansion of the chamber, so that the chamber is exposed to port 13*d* up to the point of maximum compression of the chamber. The chamber then begins expanding once again to take in fuel mixture from port 13*b*, and the cycle is repeated.

Rotary device 10 has four chambers 12*a* through 12*d*, which may each undergo the above-described stages of fuel intake, compression, expansion and exhaust in succession. Thus, rotary device 10 may form an internal combustion engine equivalent to a standard four-cylinder piston engine.

Another application for rotary device 10 is as a pump or compressor. Thus, referring to FIG. 3, ports 13*b* and 13*c* may be configured as fluid inlet ports, while ports 13*a* and 13*d* may be configured as fluid outlet ports. The expansion and compression of chambers 12*a* through 12*d* acts to draw in fluid from port 13*b* and expel the fluid from port 13*a*. Similarly, the expansion and compression of chambers 12*a* through 12*d* acts to draw in fluid from port 13*c* and expel the fluid from port 13*d*. The fluid pumped by rotary device 10 may be either a gas or a liquid.

When rotary device 10 is to pump a relatively incompressible fluid, such as water and most other liquids, the placement of ports 13*a* through 13*d* is preferably such that each chamber is exposed to either a fluid inlet port or a fluid outlet port throughout the rotation of the chamber. This design eliminates the stress on fins 15*a*, 15*b*, 17*a*, 17*b* that would otherwise be caused by an attempt to expand or compress a given quantity of the incompressible pumping fluid during periods when a chamber is not exposed to a fluid inlet or outlet port. Thus, each chamber preferably is exposed to the next fluid outlet port before it loses contact with a fluid inlet port, and vice versa.

When rotary device 10 is to act as a compressor for a compressible fluid, such as air or some other gas, fluid outlet ports 13*a* and 13*d* may be positioned closer to the horizontal medial plane of cylinder 12, so that each chamber is exposed to a fluid outlet port only after some amount of compression of the fluid has taken place within the chamber.

It will be understood that, in any application of rotary device 10, various characteristics of rotary device 10 may be altered by changing any of the variables associated with rotary device 10. For example, the size of cylinder 12 and of ports 13*a* through 13*d* may be changed to alter the capacity and/or fluid resistance of rotary device 10. In addition, the arc subtended by each fin 15*a*, 15*b*, 17*a*, 17*b* may be increased or decreased to correspondingly increase or decrease the compression ratio of rotary device 10, particularly in an internal combustion engine or compressor application. Similarly, the cross sectional shape of each fin may be altered from a simple wedge shape to improve the performance of rotary device 10.

Furthermore, various characteristics of drive assembly 18 may be changed to alter the compression and expansion characteristics of rotary device 10. For example, the number of drive shafts and universal joints that constitute drive assembly 18 may be changed, as well as the angle γ formed by any two adjacent drive shafts. Similarly, the angle Δ, denoting the orientation difference between any two universal joints attached to a drive shaft, may be changed to, for example, 60° to alter the compression ratio and compression speed of rotary device 10.

In addition, the number of fins attached to each axle 14, 16 may be increased or decreased to correspondingly change the number of chambers formed within cylinder 12. If the number of chambers within cylinder 12 is changed in this fashion, then other modifications may also be necessary to retain some of the desirable characteristics of rotary device 10 described above. Specifically, drive assembly 18 must be modified in order for each chamber to reach the same point in its expansion/compression cycle at any given point around cylinder 12. Thus, for example, if the number of fins attached to axles 14 and 16 is doubled, to form eight chambers within cylinder 12, a gear ratio of 1:2 should be established in drive assembly 18 between universal joint 18*h* and axle 14, and also between universal joint 18*o* and axle 16. This gear ratio will double the number of chamber expansion and compression cycles per revolution of axles 14 and 16. To accommodate this increased number of cycles per revolution, the number of inlet/outlet ports and ignition sources (if any) in cylinder 12 should be correspondingly increased.

Likewise, the number of chambers in cylinder 12 and the number of cycles per revolution may be cut in half by attaching only one fin to each axle 14, 16, and by establishing a gear ratio of 2:1 between universal joints 18*h* and 18*o* and axles 14 and 16, respectively. Thus, rotary device 10 may be used as a pump with only one fluid inlet port and one fluid outlet port.

It will be understood that the word "coupled" as used herein, such as when primary drive shaft 18*a* is referred to as being "coupled" to axles 14 and 16, includes a direct or indirect connection between objects, and that an indirect connection may include one or more intervening universal joints and/or drive shafts, as well as one or more intervening gear mechanisms such as those described above. Other intervening coupling mechanisms, such as worm gears, levers and pulleys, are well known in the mechanical arts and are understood to fall within the scope of the word "coupled."

It will also be understood that cylinder 12 need not have flat end-walls. Rather, a variety of radially symmetrical end-wall shapes may be preferable to improve fluid flow, combustion power transfer, or other characteristics of rotary device 10. Likewise, the outer wall of cylinder 12 need not have a uniform radius along its entire length. Thus, cylinder 12 may comprise an ellipsoid, or some other radially symmetrical shape. Therefore, the term "cylinder" as used herein designates only a radially symmetrical shape.

Figure 5:
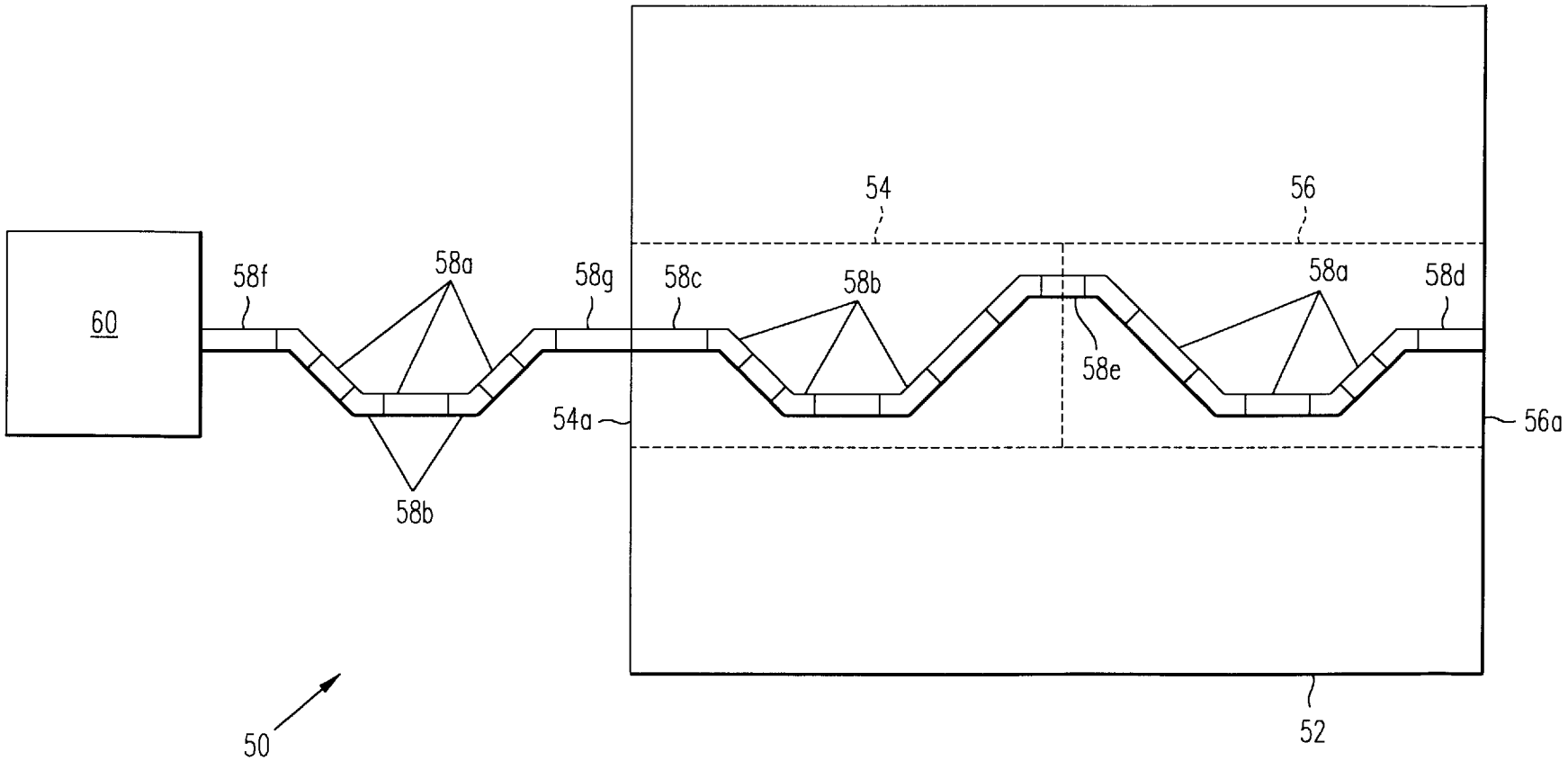
FIG. 5 is a front view of an alternative embodiment of the rotary device.

Referring to FIG. 5, an alternative embodiment 50 of rotary device 10 is shown. In this embodiment, a cylinder 52 has axles 54 and 56 with fins (not explicitly shown) attached. Thus, rotary device 50 is capable of functioning as a pump, compressor or internal combustion engine in a manner similar to rotary device 10. However, axles 54 and 56 of rotary device 50 are hollow, with a portion of drive assembly 58 enclosed therein. Each axle 54, 56 has an end-wall 54*a*, 56*a*, respectively, enclosing the interior of shafts 54, 56.

Drive assembly 58 comprises a plurality of drive shafts 58*a*, 58*c*, 58*d* connected by universal joints 58*b*, as in rotary device 10. One drive shaft 58*c* is attached to end-wall 54*a* of axle 54 and extends along the axis of cylinder 52. Another drive shaft 58*d* is attached to end-wall 56*a* of axle 56 and extends along the axis of cylinder 52. Each drive shaft 58*a*, 58*c*, 58*d* is oriented at a 45° angle with respect to the adjacent drive shafts, as in rotary device 10. As described above with respect to rotary device 10, the two universal joints 58*b* attached to each drive shaft 58*a* have a relative orientation angle Δ of 90°, or some other desirable angle to achieve the desired compression and expansion characteristics of rotary device 50. An exception to this general rule is that drive shafts 58*g* and 58*c*, which effectively form a single continuous drive shaft, have universal joints 58*b* attached to their ends which have a relative orientation angle Δ of 0°, for reasons which will become apparent.

The two axles 54 and 56 are driven by shafts 58*c* and 58*d* separated by eight universal joints 58*b* and seven drive shafts 58*a*, 58*e*. One drive shaft 58*e* is half-way between drive shaft 58*c* and drive shaft 58*d*. Drive shaft 58*e* may be made to rotate with constant angular velocity, as will be described more fully below. Thus, rotary device 50 has compression and expansion characteristics similar to those of rotary device 10.

However, since axles 54 and 56 may not be large enough in diameter to permit a motor to be housed inside, an external drive assembly component is also attached. This external component includes four drive shafts 58*a*, 58*f* and four universal joints 58*b* attached in series to a drive shaft 58*g* attached to end-wall 54*a* of axle 54.

A motor 60 rotates the first drive shaft 58*f* at a constant angular velocity. Because of the symmetrical arrangement of universal joints on either side of drive shafts 58*g* and 58*c*, central drive shaft 58*e* rotates at the same angular velocity as drive shaft 58*f*, i.e. at a constant angular velocity. Thus, central drive shaft 58*e* is analogous to primary drive shaft 18*a* of rotary device 10. As a result, axles 54 and 56 are driven at the same relative velocities as those set forth in Equations (17) and (18).

Figure 6:
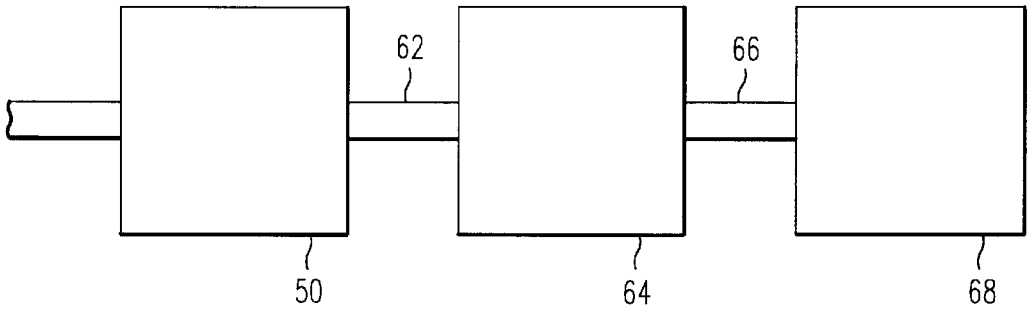
FIG. 6 is a front view of a chain of rotary devices in accordance with the present invention.

One important advantage of rotary device 50 is that a number of such rotary devices may be "chained" together, as shown in FIG. 6. A single drive shaft 62, attached to end-wall 56*a* of axle 56 in rotary device 50, is used to drive one axle of another rotary device 64. The second axle of rotary device 64 is driven by an internal drive assembly with multiple shafts connected by universal joints, such as the one described above with respect to rotary device 50. Using the equations set forth above, it may be seen that rotary device 64 will have one axle rotating at the same speed as axle 56 of rotary device 50, while the other axle rotates at the same speed as axle 54 of rotary device 50. Rotary device 64 will therefore have the same expansion and compression characteristics as rotary device 50.

Similarly, another drive shaft 66 connects the second axle of rotary device 64 to the first axle of another rotary device 68. This chain may continue indefinitely, with all rotary devices 50, 64, 68 in the chain being driven by a single motor 60. Each rotary device in the chain will have the same expansion and compression characteristics as rotary device 50. Thus, rotary devices 50, 64, 68 may be used as a set of parallel (or series) pumps, or as a multi-cylinder internal combustion engine.

Although the present invention and its advantages have been described in detail, it should be understood that various changes, substitutions, and alterations can be made therein without departing from the spirit and scope of the invention as defined by the appended claims.

I claim:

1. A rotary device comprising:

a cylinder;

a first axle operable to rotate within the cylinder, the first axle having a first fin set having at least one fin subdividing the cylinder;

a second axle operable to rotate within the cylinder, the second axle having a second fin set having at least one fin subdividing the cylinder;

a drive shaft having first and second termini;

a first universal joint chain connected between the first terminus of the drive shaft and the first axle, the first universal joint chain having a plurality of universal joints connected in series in a configuration to enhance an annular velocity difference between the drive shaft and the first axle; and a second universal joint chain connected between the second terminus of the drive shaft and the second axle, the second universal joint chain having a plurality of universal joints connected in series in a configuration to enhance an angular velocity difference between the drive shaft and the second axle.

2. The rotary device of claim 1, further comprising a plurality of ports in the cylinder for allowing fluid to flow into and out of the cylinder.

3. The rotary device of claim 1, further comprising:

a fluid inlet port formed in a wall of the cylinder, the fluid inlet port being operable to allow fluid to enter the cylinder; and a fluid outlet port formed in the wall of the cylinder, the fluid outlet port being operable to allow fluid to exit the cylinder.

4. The rotary device of claim 1, further comprising a motor operable to rotate the drive shaft.

5. The rotary device of claim 1, further comprising an ignition source attached to the cylinder, the ignition source being operable to ignite a fuel within the cylinder.

6. The rotary device of claim 1, wherein the first universal joint chain comprises:

a first universal joint coupled to the drive shaft;

a second universal joint coupled to the first axle; and a plurality of rotatable objects connected between the first universal joint and the second universal joint, at least one of the rotatable objects being coupled to an adjacent one of the rotatable objects by a third universal joint.

7. The rotary device of claim 6, wherein the second universal joint chain comprises:

a first universal joint coupled to the drive shaft;

a second universal joint coupled to the second axle; and a plurality of rotatable objects connected between the first universal joint and the second universal joint, at least one of the rotatable objects being coupled to an adjacent one of the rotatable objects by a third universal joint.

8. The rotary device of claim 1, further comprising:

a second cylinder;

a third axle operable to rotate within the second cylinder, the third axle having a third fin set having at least one fin subdividing the cylinder;

a fourth axle operable to rotate within the second cylinder, the fourth axle having a fourth fin set having at least one fin subdividing the cylinder;

a drive mechanism coupling the second and third axles, the drive mechanism being operable to rotate the third axle in response to a rotation of the second axle; and a third universal joint chain connected between the third and fourth axles, the third universal joint chain having a plurality of universal joints connected in series in a configuration to enhance an angular velocity difference between the third axle and the fourth axle.

9. An internal combustion engine comprising:

a cylinder;

a first axle operable to rotate within the cylinder, the first axle having a first fin set having at least one fin subdividing the cylinder;

a second axle operable to rotate within the cylinder, the second axle having a second fin set having at least one fin subdividing the cylinder;

a torque transfer assembly connected to the first axle and the second axle, the torque transfer assembly having a rotatable object and first and second universal joint chains;

the first universal joint chain being connected between the rotatable object and the first axle, the first universal joint chain having a plurality of universal joints connected in series in a configuration to enhance an angular velocity difference between the rotatable object and the first axle;

the second universal joint chain being connected between the rotatable object and the second axle, the second universal joint chain having a plurality of universal joints connected in series in a configuration to enhance an angular velocity difference between the rotatable object and the second axle; and an ignition source attached to the cylinder, the ignition source being operable to ignite a fuel within the cylinder.

10. The internal combustion engine of claim 9, further comprising a fuel inlet port formed in the cylinder, the fuel inlet port being operable to introduce fuel into the cylinder.

11. The internal combustion engine of claim 10, further comprising an exhaust port formed in the cylinder, the exhaust port being operable to allow exhaust to exit the cylinder.

12. The internal combustion engine of claim 9, wherein the ignition source comprises a spark plug.

13. The internal combustion engine of claim 9, wherein the ignition source comprises a glow plug.

14. A pump comprising:

a cylinder;

a first axle operable to rotate within the cylinder, the first axle having a first fin set having at least one fin subdividing the cylinder;

a second axle operable to rotate within the cylinder, the second axle having a second fin set having at least one fin subdividing the cylinder;

a drive assembly connected to the first axle and the second axle, the drive system having a drive shaft coupled to the first axle by a first universal joint chain, the drive shaft being coupled to the second axle by a second universal joint chain, the drive assembly further having a motor operable to rotate the drive shaft;

the first universal joint chain being connected between the drive shaft and the first axle, the first universal joint chain having a plurality of universal joints connected in series in a configuration to enhance an angular velocity difference between the drive shaft and the first axle;

the second universal joint chain being connected between the drive shaft and the second axle, the second universal joint chain having a plurality of universal joints connected in series in a configuration to enhance an angular velocity difference between the drive shaft and the second axle;

a fluid inlet port formed in the cylinder, the fluid inlet port being operable to admit a fluid into the cylinder; and a fluid outlet port formed in the cylinder, the fluid outlet port being operable to allow the fluid to exit the cylinder.

15. The pump of claim 14, wherein the fin sets form a plurality of chambers within the cylinder.

16. The pump of claim 15, wherein the drive assembly is operable to rotate the first and second axles so as to sequentially expose each chamber to the fluid inlet port and expand each chamber while exposed to the fluid inlet port.

17. The pump of claim 16, wherein the drive assembly is further operable to rotate the first and second axles so as to sequentially expose each chamber to the fluid outlet port and compress each chamber while exposed to the fluid outlet port.

18. The pump of claim 14, wherein the drive assembly comprises:

a primary drive shaft;

a first universal joint attached to a first terminus of the primary drive shaft;

a second universal joint attached to a second terminus of the primary drive shaft;

a first secondary drive shaft having a first terminus attached to the first universal joint;

a second secondary drive shaft having a first terminus attached to the second universal joint;

a third universal joint attached to a second terminus of the first secondary drive shaft, the third universal joint being coupled to the first axle; and a fourth universal joint attached to a second terminus of the second secondary drive shaft, the fourth universal joint being coupled to the second axle.

19. The pump of claim 18, wherein the drive assembly further comprises:

a first tertiary drive shaft having a first terminus attached to the third universal joint;

a second tertiary drive shaft having a first terminus attached to the fourth universal joint;

a fifth universal joint attached to a second terminus of the first tertiary drive shaft, the fifth universal joint being coupled to the first axle; and a sixth universal joint attached to a second terminus of the second tertiary drive shaft, the sixth universal joint being coupled to the second axle.

20. A method for pumping a fluid, comprising:

rotating a first universal joint by a primary drive shaft;

rotating a second universal joint by the primary drive shaft;

rotating a first secondary drive shaft by the first universal joint, the first secondary drive shaft being oriented at an angle with respect to the primary drive shaft;

rotating a second secondary drive shaft by the second universal joint, the second secondary drive shaft being oriented at an angle with respect to the primary drive shaft;

rotating a third universal joint by the first secondary drive shaft;

rotating a fourth universal joint by the second secondary drive shaft;

rotating a first tertiary drive shaft by the third universal joint, the first tertiary drive shaft being oriented at an angle with respect to the first secondary drive shaft, the third universal joint being coupled to the first secondary drive shaft in a configuration to enhance an angular velocity difference between the primary drive shaft and the first tertiary drive shaft;

rotating a second tertiary drive shaft by the fourth universal joint, the second tertiary drive shaft being oriented at an angle with respect to the second secondary drive shaft, the fourth universal joint being coupled to the second secondary drive shaft in a configuration to enhance an angular velocity difference between the primary drive shaft and the second tertiary drive shaft;

rotating a first axle by the first tertiary drive shaft;

rotating a second axle by the second tertiary drive shaft;

rotating at least one fin within a cylinder by the first axle;

rotating at least one fin within the cylinder by the second axle, the fins forming a plurality of expandable and compressible chambers within the cylinder;

rotating a selected one of the drive shafts by a motor;

expanding a selected one of the chambers by the rotation of the fins while the selected chamber is exposed to a fluid inlet port formed in the cylinder so as to draw the fluid into the selected chamber; and compressing a selected one of the chambers by the rotation of the fins while the selected chamber is exposed to a fluid outlet port formed in the cylinder so as to expel the fluid from the selected chamber into the fluid outlet port.

21. The method of claim 20, further comprising repeating the compression and expansion of each of the plurality of chambers in succession so as to pump the fluid from the fluid inlet port to the fluid outlet port.

* * * * *